US010974886B2

(12) United States Patent
Liao et al.

(10) Patent No.: US 10,974,886 B2
(45) Date of Patent: Apr. 13, 2021

(54) AIR-SEALED BAG WITH ENHANCED SIDE AND CORNER PROTECTION

(71) Applicant: KUNSHAN AIRBAG PACKING CORP., Kunshan (CN)

(72) Inventors: Kao-Hsiung Liao, Kunshan (CN); Ping-Yuan Liao, Kunshan (CN)

(73) Assignee: KUNSHAN AIRBAG PACKING CORP., Kunshan (CN)

( * ) Notice: Subject to any disclaimer, the term of this patent is extended or adjusted under 35 U.S.C. 154(b) by 106 days.

(21) Appl. No.: 16/425,620

(22) Filed: May 29, 2019

(65) Prior Publication Data

US 2019/0367241 A1 Dec. 5, 2019

(30) Foreign Application Priority Data

May 31, 2018 (TW) ..... 10711882.5

(51) Int. Cl.
*B65D 81/05* (2006.01)
*B65D 81/03* (2006.01)

(52) U.S. Cl.
CPC ..... *B65D 81/052* (2013.01); *B65D 81/03* (2013.01); *B65D 2581/051* (2013.01)

(58) Field of Classification Search
CPC ..... B65D 81/02; B65D 81/03; B65D 81/05; B65D 81/052; B65D 2581/051
USPC ..... 206/522
See application file for complete search history.

(56) References Cited

U.S. PATENT DOCUMENTS

| | | | | |
|---|---|---|---|---|
| 9,428,315 | B2 * | 8/2016 | Liao | B65D 81/052 |
| 9,616,634 | B2 * | 4/2017 | Liao | B31D 5/0073 |
| 2013/0168286 | A1 * | 7/2013 | Liao | B65D 81/052 206/522 |

FOREIGN PATENT DOCUMENTS

| | | | | |
|---|---|---|---|---|
| DE | 102013223633 | A1 * | 6/2014 | B65D 1/052 |
| EP | 2610050 | A2 * | 7/2013 | B65D 81/02 |
| EP | 2921739 | A1 * | 9/2015 | B65D 81/052 |
| TW | 201529437 | A | 8/2015 | |

OTHER PUBLICATIONS

Taiwan Patent Office, Office Action, Patent Application Serial No. TW107118825, dated Jan. 19, 2019.

* cited by examiner

*Primary Examiner* — Bryon P Gehman
(74) *Attorney, Agent, or Firm* — Rabin & Berdo, P.C.

(57) ABSTRACT

An air-sealed bag with enhanced side and corner protection includes a box body and first protection walls. The box body is formed by a plurality of first air columns and includes two side walls and a bottom wall. The bottom wall is at bottom ends of the side walls and is connected with the side walls. The side walls and the bottom wall form a receiving space. The outer surface of the first air column adjacent to the joint between the side walls forms a chamfered shape. The first protection walls are on the outer side surfaces of the side walls, respectively. Each of the first protection walls includes two first protection portions, and each first protection portion includes a first protection air column. Each of the first protection portions is attached on the first air column of which the outer surface forms the chamfered shape.

21 Claims, 7 Drawing Sheets

AIR-SEALED BAG WITH ENHANCED SIDE AND CORNER PROTECTION

CROSS-REFERENCE TO RELATED APPLICATION

This non-provisional application claims priority under 35 U.S.C. § 119(a) to Patent Application No. 107118825 filed in Taiwan, R.O.C. on May 31, 2018, the entire contents of which are hereby incorporated by reference.

BACKGROUND

Technical Field

The present invention relates to an air-sealed bag, particularly to an air-sealed bag capable of enhancing corner protection.

Related Art

Logistics transportation is used widely in today's society. Requirements for packaging materials for transporting articles are quite high, focusing on shock proofing and drop resistance, and preventing articles from being directly damaged by external forces.

At present, foam, paper, plastics, corrugated paper, air bags and other materials are used as packaging materials, with different shockproof and anti-drop effects. Generally, after an article is packaged, although the appearance seems to be protective sufficiently, collision inevitably occurs during the transportation, once the article is put into a carton or a container, and gaps are formed between the sides and corners of the packaging material and the corners of the carton or the container, and therefore, the effect of protecting the article by the corners of the packaging material is poor. After multiple collisions with the sides and corners of the carton or the container, the article is damaged due to easily-caused insufficient protection of the packaging material.

SUMMARY

An embodiment of the present invention provides an air-sealed bag with enhanced side and corner protection, including a box body and first protection walls. The box body is formed by a plurality of first air columns and includes two side walls and a bottom wall. The side walls are opposite to each other and two sides of each of the side walls are connected with two sides of the corresponding side wall, respectively. The bottom wall is at bottom ends of the side walls and is connected with the side walls. The side walls and the bottom wall form a receiving space. Among the first air columns of the side walls, an outer surface of the first air column adjacent to the joint between the side walls forms a chamfered shape. The first protection walls are on the outer side surfaces of the side walls of the box body, respectively. Each of the first protection walls includes two first protection portions, and each first protection portion includes a first protection air column. Each of the first protection portions is attached on the first air column of which the outer surface forms the chamfered shape.

The air-sealed bag with enhanced side and corner protection as described above, in an embodiment, the first protection air columns of the first protection walls further extend to the outer side surface of the bottom wall.

The air-sealed bag with enhanced side and corner protection as described above, in an embodiment, each first protection wall further includes a first planar portion between the first protection portions, and the two sides of the first planar portion are respectively connected with the first protection air columns of the first protection portions.

The air-sealed bag with enhanced side and corner protection as described above, in an embodiment, each first protection wall is connected to the upper side of one of the side walls and is located on the outer side surface of the side wall in a reflexed manner.

The air-sealed bag with enhanced side and corner protection as described above, in an embodiment, the first protection walls are connected to the joints of the side walls and are located on the outer side surfaces of the side walls in a reflexed manner.

The air-sealed bag with enhanced side and corner protection as described above further includes, in an embodiment, a cover body and second protection walls, the cover body is formed by a plurality of second air columns, the cover body is combined with the box body to cover the receiving space, the cover body includes two side walls and a top wall, the side walls are connected with the top wall to form a socket space, and among the second air columns of the side walls, the outer surface of each second air column adjacent to the joint between the side walls forms another chamfered shape, the second protection walls are on the outer side surfaces of the side walls of the cover body, each of the second protection walls includes two second protection portions, each second protection portion includes a second protection air column, and each of the second protection portions is attached on the second air column of which the outer surface forms another chamfered shape.

The air-sealed bag with enhanced side and corner protection as described above, in an embodiment, the second protection air columns of the second protection walls further extend to the outer side surface of the top wall.

The air-sealed bag with enhanced side and corner protection as described above, in an embodiment, each second protection wall further includes a second planar portion between the second protection portions, and the two sides of the second planar portion are respectively connected with the second protection air columns of the second protection portions.

The air-sealed bag with enhanced side and corner protection as described above, in an embodiment, each second protection wall is connected to the upper side of one of the side walls and is located on the outer side surface of the side wall in a reflexed manner.

The air-sealed bag with enhanced side and corner protection as described above, in an embodiment, the second protection walls are connected to the joints of the side walls and are located on the outer side surfaces of the side walls in a reflexed manner.

The air-sealed bag with enhanced side and corner protection provided by at least one of the above embodiments enhances the protection on the sides and corners through the first and second protection walls, and perfectly protects the four sides and corners of the transported object, thereby solving the problems in the prior art.

DETAILED DESCRIPTION

Figure 1:
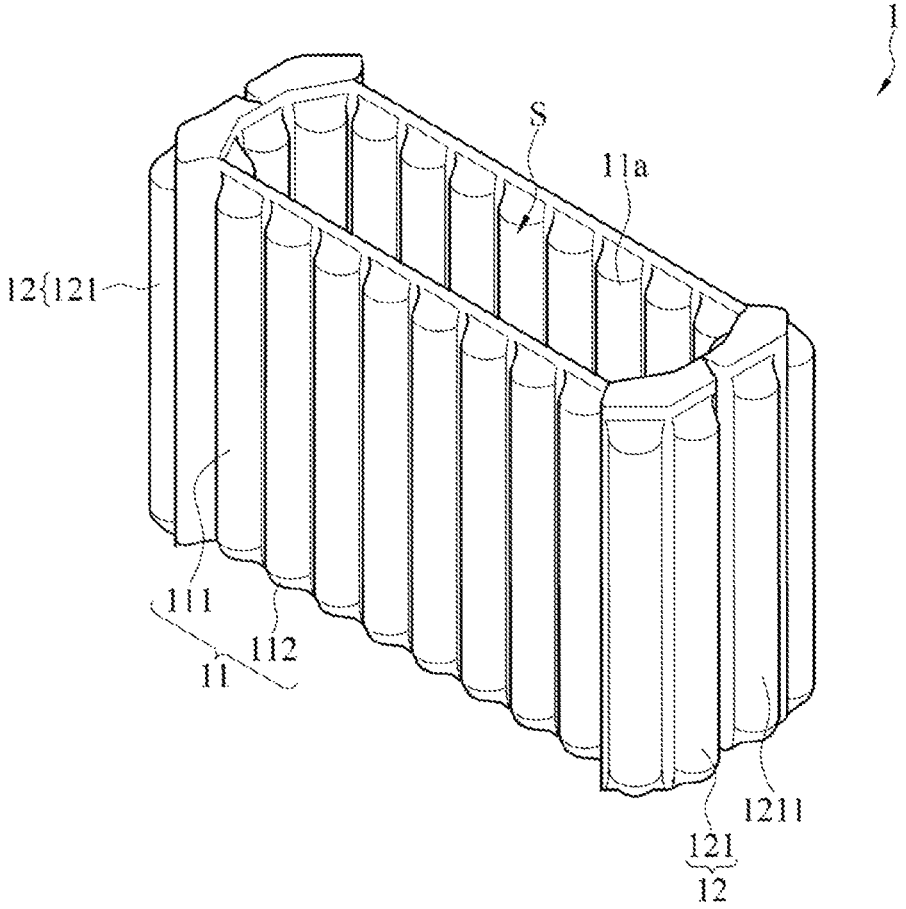
FIG. 1 is an appearance schematic view of a first embodiment of an air-sealed bag with enhanced side and corner protection according to the present invention.
Figure 2:
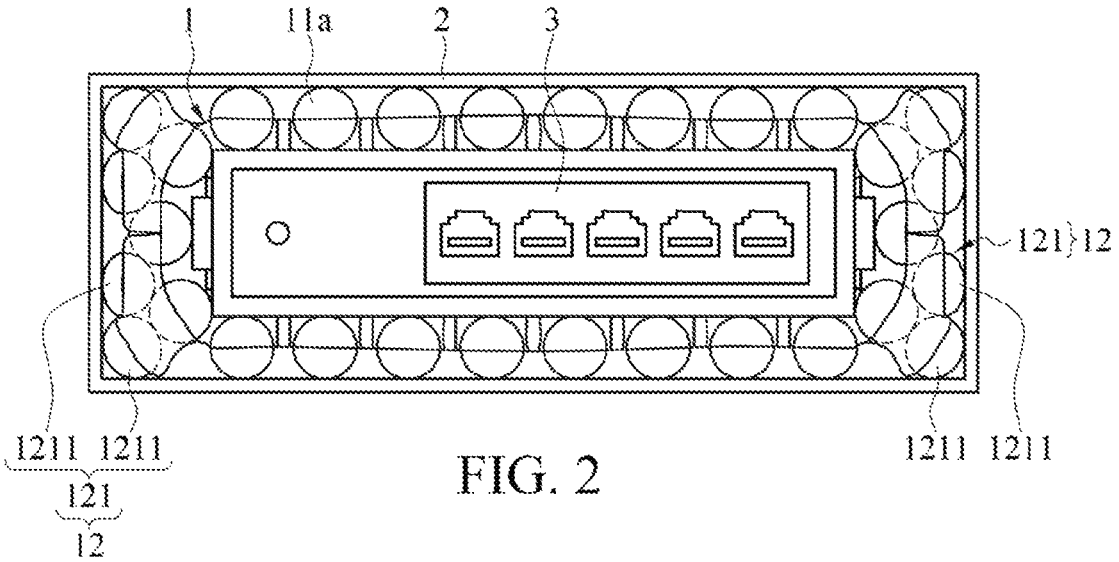
FIG. 2 is a top view of the first embodiment of the air-sealed bag with enhanced side and corner protection in a use state according to the present invention.

Refer to FIG. 1 to FIG. 2, which are respectively an appearance schematic view of a first embodiment of an air-sealed bag 1 with enhanced side and corner protection, and a top view of the first embodiment of the air-sealed bag 1 with enhanced side and corner protection in a use state according to the present invention.

The air-sealed bag 1 includes a box body 11 and first protection walls 12. The box body 11 is formed by a plurality of first air columns 11*a* and includes two side walls 111 and a bottom wall 112. The side walls 111 are opposite to each other and are connected to each other on two sides. The bottom wall 112 is at bottom ends of the side walls 111 and is connected with the side walls 111. Thus, the side walls 111 and the bottom wall 112 form a receiving space S in which a transported object 3 is placed. As shown in FIG. 1, an outer surface of the first air column 11*a* adjacent to the joint between the side walls 111 forms a chamfered shape. The chamfered shapes and the sides or corners of a carton 2 form gaps, which is not conducive to the transportation of the object 3. The chamfered shapes collide with the sides and corners of the carton 2 multiple times during transportation, thereby reducing the protection capability of the air-sealed bag 1, and damaging the sides or corners of the object 3.

The first protection walls 12 are arranged at the outer part of the box body 11. The first protection walls 12 are on the outer side surfaces of the side walls 111 of the box body 11. Each of the first protection walls 12 includes two first protection portions 121, and each first protection portion includes a first protection air column 1211. Each of the first protection portions 121 is attached on the first air column 11*a* of which the outer surface forms the chamfered shape. In this way, the first protection walls 12 can complement the protection capability of the first air columns 11*a* that form chamfered shapes, and can fill the gaps between the chamfered shapes and the carton 2 on the other hand, so that the transported object 3 can be perfectly protected.

In some embodiments, the first protection wall 12 is arranged outside each side wall 111, or the first protection wall 12 is arranged outside one of the side walls, which is not limited in the present invention and depends on the requirements of the transported object 3. In some embodiments, the number of the first protection air column 1211 may not be only one, and one or more first protection air columns 1211 may be used according to the chamfered shape formed by the first air columns 11*a*. When the gaps between the chamfered shapes of the first air columns 11*a* and the Side and Corners of the Carton 2 are Larger, More First protection air columns 1211 are used to fill the gaps, which is not limited in the present invention.

Figure 3:
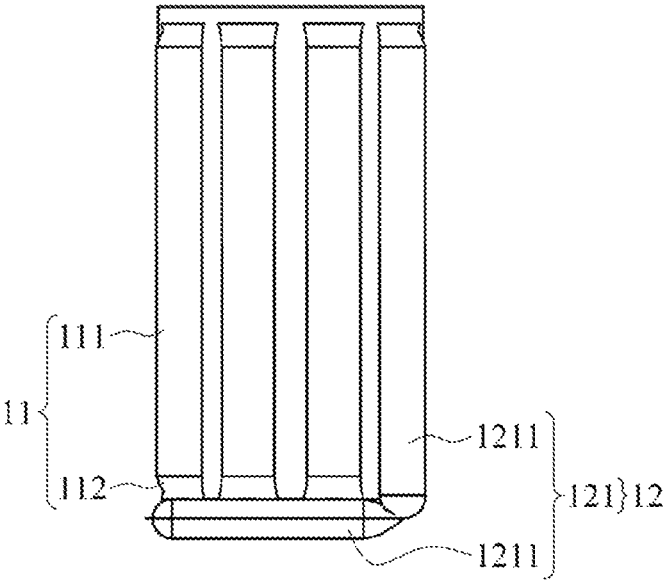
FIG. 3 is a partial side view of a second embodiment of the air-sealed bag with enhanced side and corner protection according to the present invention.

Refer to FIG. 3, which is a partial side view of a second embodiment of the air-sealed bag 1 with enhanced side and corner protection according to the present invention. In the present embodiment, the first protection air column 1211 of the first protection portion 121 of the first protection wall 12 further extends to the outer side surface of the bottom wall 112. Thus, the circumferential protection of the air-sealed bag 1 can be further enhanced.

Figure 4:
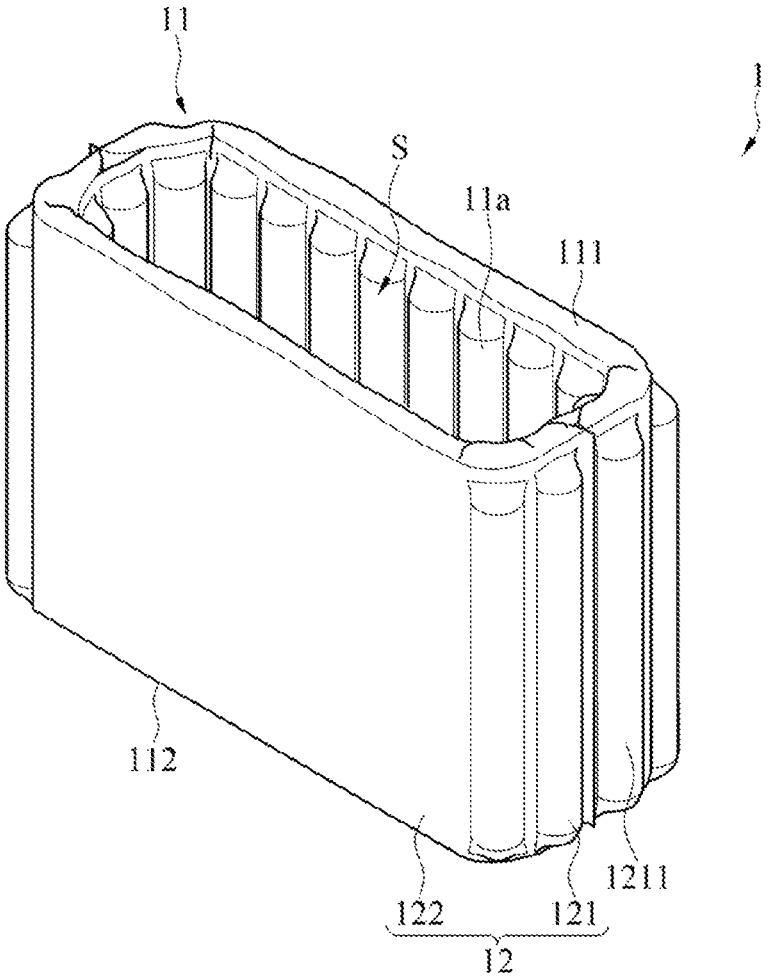
FIG. 4 is an appearance schematic view of a third embodiment of the air-sealed bag with enhanced side and corner protection according to the present invention.

Refer to FIG. 4, which is an appearance schematic view of a third embodiment of the air-sealed bag 1 with enhanced side and corner protection according to the present invention. In the present embodiment, each first protection wall 12 further includes a first planar portion 122 between the first protection portions 121, and two sides of the first planar portion 122 are respectively connected with the first protection air columns 1211 of the first protection portions 121. Since the air-sealed bag 1 is formed by a plurality of air columns, the structure of the first protection walls 12 can be designed according to actual needs by a operator, e.g., heat seal lines are provided to close inflation channels of the first planar portions 122, so that only the channels of the first protection air columns 1211 are full of air. In this way, only the parts that need to be enhanced or protected are protected by the first protection portions 121 (the first protection air columns 1211), while the first planar portions 122 are only attached on the outer surfaces of the other first air columns 11*a*. On the other hand, the overall volume can also be reduced, so that the air-sealed bag can be conveniently placed in the carton 2.

Referring again to FIG. 1, in the present embodiment, each first protection wall 12 is connected to the upper side of one of the side walls 111 and is located on the outer side surface of the side wall 111 in a reflexed manner. As described above, the air-sealed bag 1 is formed by a plurality of air columns, and the air columns are formed by arranging heat seal lines. In the present embodiment, the air-sealed bag 1 with enhanced side and corner protection is a sheet material superposed by a plurality of films before inflation, the box body 11 is formed during inflation and bonding, then the first protection walls are reflexed onto the outer side surfaces of the side walls 111, the first protection air columns 1211 on the side are bonded with the first air columns 11*a* on the corresponding side by the heat seal lines, and the air-sealed bag 1 with enhanced side and corner protection in the present embodiment is thus completed.

Certainly, the present invention is not limited thereto. In some embodiments, the first protection walls 12 can be independently bonded with the box body 11, not combined by the same film.

Figure 5A:
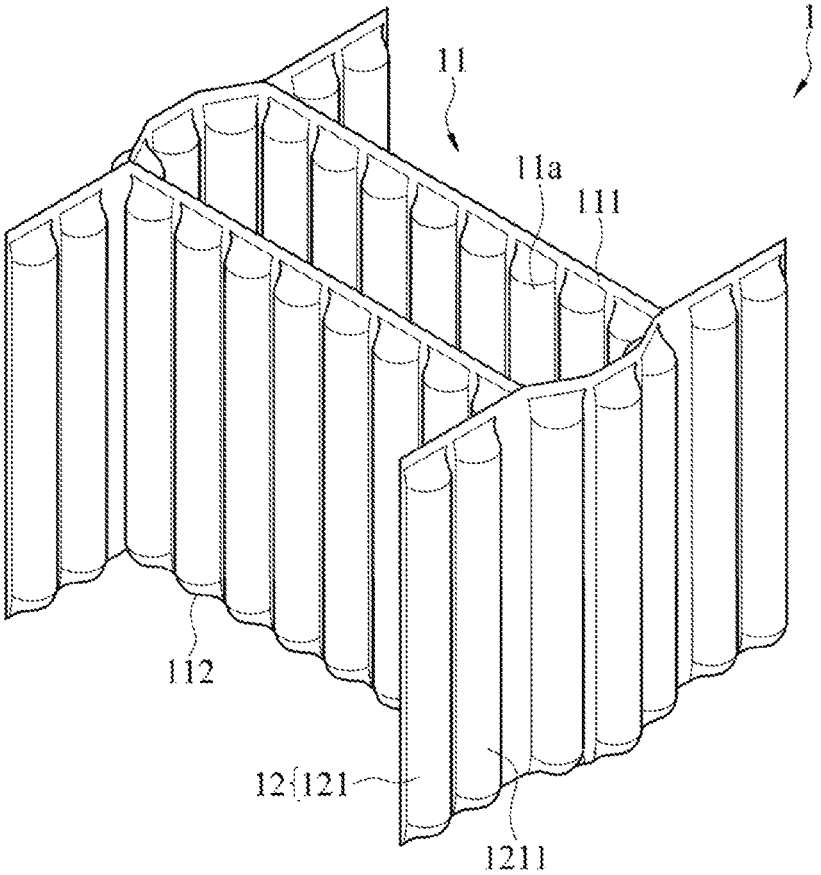
FIG. 5A is a schematic view of a fourth embodiment of the air-sealed bag with enhanced side and corner protection in a use state according to the present invention.
Figure 5B:
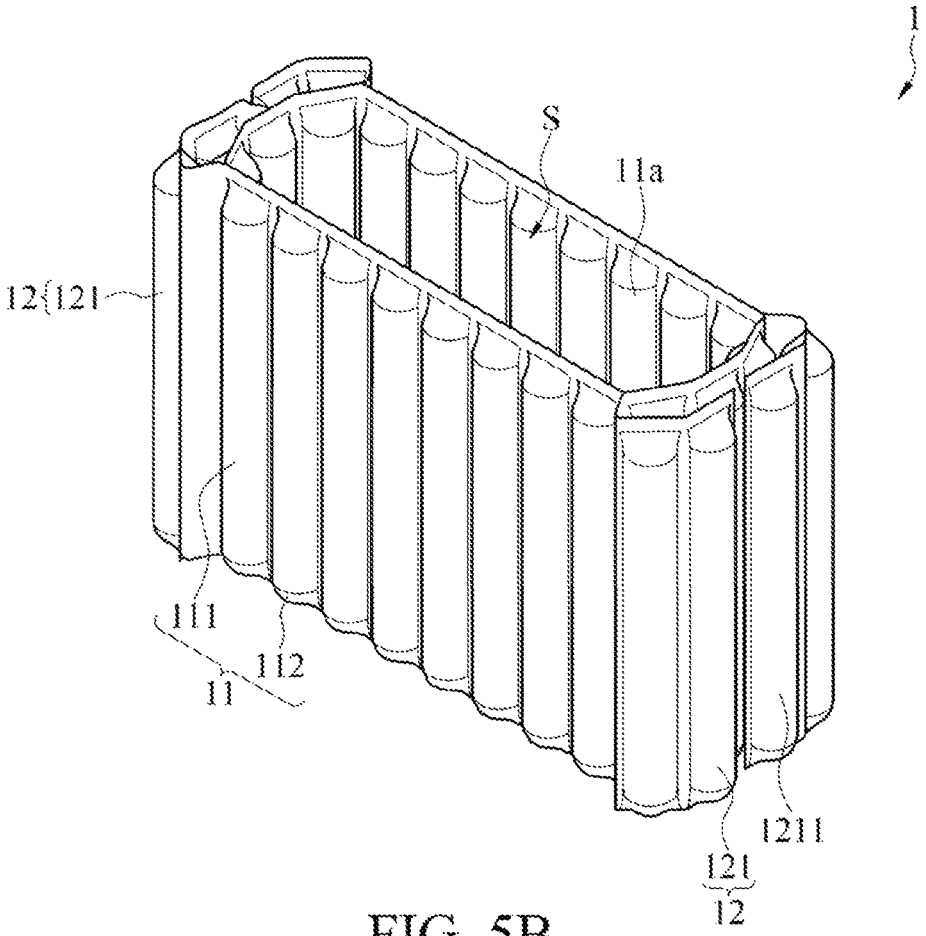
FIG. 5B is a schematic view of the fourth embodiment of the air-sealed bag with enhanced side and corner protection in a use state according to the present invention.

Refer to FIG. 5A and FIG. 5B, which are respectively a schematic view of a fourth embodiment of the air-sealed bag 1 with enhanced side and corner protection in a use state according to the present invention. In the present embodiment, unlike the first embodiment, the first protection walls 12 are connected to the joints of the side walls 111 and are located on the outer side surfaces of the side walls 111 in a reflexed manner. As described above, in some embodiments, the air-sealed bag 1 with enhanced side and corner protection is formed by a plurality of films and arranged heat seal lines through inflation. The first protection walls 12 are formed on the two sides of the box body 11 by means of heat seal lines by a operator, and are located on the outer side surfaces of the side walls 111 by reflexing or bonding, which also can protect the first air columns 11*a* Having Chamfered Outer Surfaces and further protect the object 3 in the box body 11. In some embodiments, the first protection walls 12 can be independently bonded with the two sides of the box body 11, not combined by the same film.

In some embodiments, the upper ends of the side walls 111 of the air-sealed bag 1 with enhanced side and corner protection may be bonded to each other by heat seal lines to cover the receiving space S. In still other embodiments, sealing may not necessary, which is determined by the transported object 3 by a operator, and the present invention is not limited thereto. In still other embodiments, the air-sealed bag 1 with enhanced side and corner protection further includes a cover body 13, as shown in the following embodiment.

Figure 6:
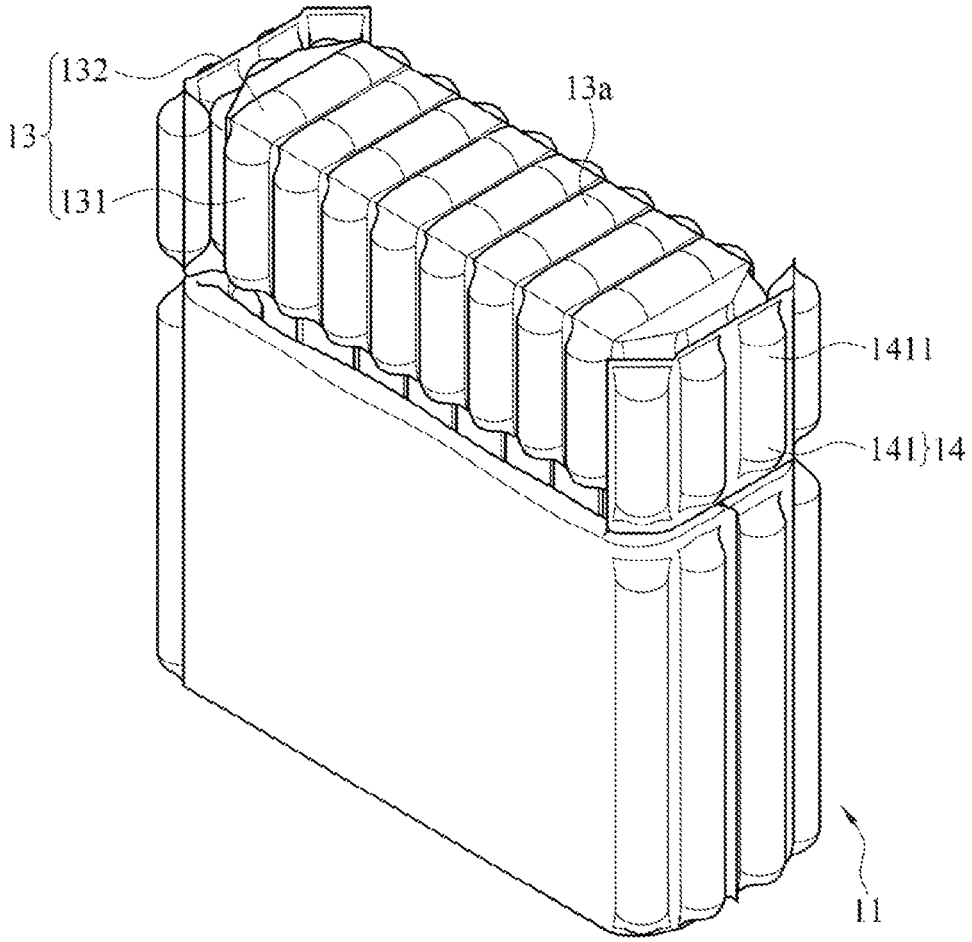
FIG. 6 is an appearance schematic view of a fifth embodiment of the air-sealed bag with enhanced side and corner protection according to the present invention.

Refer to FIG. 6, which is an appearance schematic view of a fifth embodiment of the air-sealed bag 1 with enhanced side and corner protection according to the present invention. In the present embodiment, the air-sealed bag 1 with enhanced side and corner protection further includes a cover body 13, and second protection walls 14.

The cover body 13 is formed by a plurality of second air columns 13*a*, and the cover body 13 can be combined with the box body 11 to cover the receiving space S. The cover body 13 includes two side walls 131, a top wall 132 and second protection walls 14. The side walls 131 are connected with the top wall to form a socket space. When the size of the transported object 3 is larger than the receiving space S, the socket space can receive the portion, protruding out of the receiving space S, of the object 3, and is combined with the box body 11 to completely enclose the object 3.

With respect to the second air column 13*a* of the side walls 131, the outer surface of each second air column 13*a* adjacent to the joint between the side walls 131 of the cover body 13 forms another chamfered shape. The second protection walls 14 are on the outer side surfaces of the side walls 131 of the cover body 13. Each of the second protection walls 14 includes two second protection portions 141, and each second protection portion 141 includes a second protection air column 1411. Each of the second protection portions 141 is attached on the second air column 13*a* of which the outer surface forms another chamfered shape. As described above, the air columns forming another chamfered shape (the first air columns in the box body 11, the second air columns 13*a* in the cover body 13) form gaps with the sides and corners of the carton 2 to increase the collision between the air-sealed bag 1 and the carton 2, which is not conducive to transportation. The cover body 13 also suffers from the same problem, so that the second protection walls 14 can substantially fill the gaps to enhance the protection capability of the air columns forming the chamfered shape.

Figure 7:
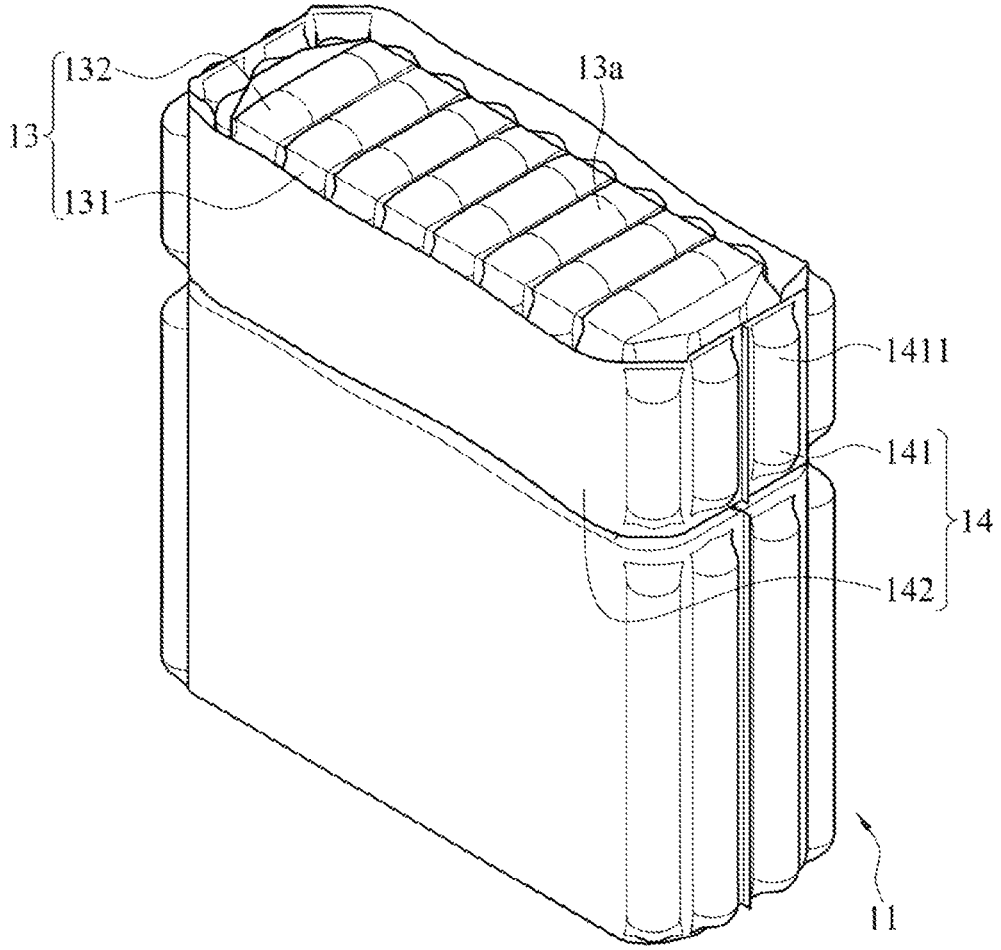
FIG. 7 is an appearance schematic view of a sixth embodiment of the air-sealed bag with enhanced side and corner protection according to the present invention.

Refer to FIG. 7, which is an appearance schematic view of a sixth embodiment of the air-sealed bag 1 with enhanced side and corner protection according to the present invention. With respect to the cover body 13, each second protection wall 14 further includes a second planar portion 142 located between the second protection portions 141, and two sides of the second planar portion 142 are respectively connected with the second protection air columns 1411 of the second protection portions 141. In other words, the second planar portions 142 are provided according to the requirements of the operator and the transported object 3, the second planar portions 142 are designed with heat seal lines, and air is not inflated to the second planar portions 142, so that the second planar portions 142 do not contain air columns, which can reduce the overall volume (the object 3 and the air-sealed bag 1).

Moreover, in some embodiments, referring again to the structure of the box body 11 of FIG. 3, similarly, with respect to the cover body 13, the second protection air columns 1411 of the second protection walls 14 further extend to the outer side surface of the top wall 132 to enhance the protection capability of the cover body 13 on the object 3.

In some embodiments, similar to the first protection walls 12 as described above, each second protection wall 14 is connected to the upper side of one of the side walls 131 and is located on the outer side surface of the the side wall 131 in a reflexed manner. In still other embodiments, the second protection walls 14 are connected to the joints of the side walls 131 and are located on the outer side surfaces of the side walls 131 in a reflexed manner. The second protection walls 14 can be a portion of the film combination and are located on the outer side surfaces of the side walls 131 of the cover body 13 in a reflexed manner. In some embodiments, the second protection walls 14 can be independently connected to the cover body 13, for example, by heat sealing, and the present invention is not limited thereto.

In an embodiment, the cover body 13 and the box body 11 are both formed by the same film. For example, the receiving space S of the box body 11 is opposite to the socket space of the cover body 13, and a side edge of the cover body 13 is connected with a side edge of the box body 11. In another embodiment, the cover body 13 and the box body 11 are two independent members. After the object 3 is received and socketed respectively, the cover body 13 is further connected with the box body 11 by, for example, heat sealing or using other adhesive, so that the air-sealed bag 1 with enhanced side and corner protection achieves the effect of perfectly protecting the object 3.

In the above embodiment, the box body 11 and the cover body 13 are of square structures. However, in an embodiment, the box body 11 and the cover body 13 are of cylindrical structures, and the present invention is not limited thereto.

According to the air-sealed bag with enhanced side and corner protection provided by at least one of the above embodiments, the first protection walls on the outer side of the box body effectively fill the gaps between the chamfered shapes of the air columns and the sides and corners of the carton to enhance the protection of the air-sealed bag on the sides and corners. In some embodiments, the air-sealed bag with enhanced side and corner protection further includes a cover body, and the second protection walls on the outer side of the cover body can also fill the gaps between the chamfered shapes of the air columns and the sides and corners of the carton. In this way, the four sides and corners of the transported object can be perfectly protected to achieve great benefits.

What is claimed is:

1. An air-sealed bag with enhanced side and corner protection, comprising:

a box body, formed by a plurality of first air columns, comprising:

two side walls opposite to each other and connected to each other on two sides, and a bottom wall, which is at bottom ends of the side walls and is connected with the side walls, wherein the side walls and the bottom wall form a receiving space, and among the first air columns of the side walls, an outer surface of the first air column adjacent to a joint between the side walls forms a chamfered shape; and first protection walls on outer side surfaces of the side walls of the box body, wherein each of the first protection walls comprises:

two first protection portions, each first protection portion comprising a first protection air column, and being attached on the first air column which forms the chamfered shape, and a first planar portion between the first protection portions, two sides of the first planar portion being respectively connected with the first protection air columns of the two first protection portions.

2. The air-sealed bag with enhanced side and corner protection according to claim 1, wherein the first protection air columns of the first protection walls further extend to an outer side surface of the bottom wall.

3. The air-sealed bag with enhanced side and corner protection according to claim 1, further comprising a cover body and second protection walls, wherein the cover body is formed by a plurality of second air columns, the cover body is combined with the box body to cover the receiving space, the cover body comprises two side walls and a top wall, wherein the side walls thereof are connected with the top wall to form a socket space, and among the second air columns of the side walls thereof, an outer surface of the second air column adjacent to a joint between the side walls of the cover body forms another chamfered shape, the second protection walls are on outer side surfaces of the side walls of the cover body, each of the second protection walls comprises two second protection portions, each second protection portion comprises a second protection air column, and each of the second protection portions is attached on the second air column of which the outer surface forms the another chamfered shape.

4. The air-sealed bag with enhanced side and corner protection according to claim 3, wherein the second protection air columns of the second protection walls further extend to an outer side surface of the top wall.

5. The air-sealed bag with enhanced side and corner protection according to claim 3, wherein each second protection wall further comprises a second planar portion between the second protection portions, and two sides of the second planar portion are respectively connected with the second protection air columns of the second protection portions.

6. The air-sealed bag with enhanced side and corner protection according to claim 3, wherein each second protection wall is connected to an upper side of one of the side walls and is located on the outer side surface of one of the side walls in a reflexed manner.

7. The air-sealed bag with enhanced side and corner protection according to claim 3, wherein the second protection walls are connected to joints of the side walls and are located on the outer side surfaces of the side walls in a reflexed manner.

8. An air-sealed bag with enhanced side and corner protection, comprising:

a box body, formed by a plurality of first air columns, comprising:

two side walls opposite to each other and connected to each other on two sides, and a bottom wall, which is at bottom ends of the side walls and is connected with the side walls, wherein the side walls and the bottom wall form a receiving space, and among the first air columns of the side walls, an outer surface of the first air column adjacent to a joint between the side walls forms a chamfered shape; and first protection walls on outer side surfaces of the side walls of the box body, wherein each of the first protection walls comprises two first protection portions, each first protection portion comprising a first protection air column, and being attached on the first air column which forms the chamfered shape, and each first protection wall is connected to an upper side of one of the side walls, and is located on one of the outer side surfaces of the side walls in a reflexed manner.

9. The air-sealed bag with enhanced side and corner protection according to claim 8, wherein the first protection air columns of the first protection walls further extend to an outer side surface of the bottom wall.

10. The air-sealed bag with enhanced side and corner protection according to claim 8, further comprising a cover body and second protection walls, wherein the cover body is formed by a plurality of second air columns, the cover body is combined with the box body to cover the receiving space, the cover body comprises two side walls and a top wall, wherein the side walls thereof are connected with the top wall to form a socket space, and among the second air columns of the side walls thereof, an outer surface of the second air column adjacent to a joint between the side walls of the cover body forms another chamfered shape, the second protection walls are on outer side surfaces of the side walls of the cover body, each of the second protection walls comprises two second protection portions, each second protection portion comprises a second protection air column, and each of the second protection portions is attached on the second air column of which the outer surface forms the another chamfered shape.

11. The air-sealed bag with enhanced side and corner protection according to claim 10, wherein the second protection air columns of the second protection walls further extend to an outer side surface of the top wall.

12. The air-sealed bag with enhanced side and corner protection according to claim 10, wherein each second protection wall further comprises a second planar portion between the second protection portions, and two sides of the second planar portion are respectively connected with the second protection air columns of the second protection portions.

13. The air-sealed bag with enhanced side and corner protection according to claim 10, wherein each second protection wall is connected to an upper side of one of the side walls and is located on the outer side surface of one of the side walls in a reflexed manner.

14. The air-sealed bag with enhanced side and corner protection according to claim 10, wherein the second protection walls are connected to joints of the side walls and are located on the outer side surfaces of the side walls in a reflexed manner.

15. An air-sealed bag with enhanced side and corner protection, comprising:

a box body, formed by a plurality of first air columns, comprising:

two side walls opposite to each other and connected to each other on two sides, and a bottom wall, which is at bottom ends of the side walls and is connected with the side walls, wherein the side walls and the bottom wall form a receiving space, and among the first air columns of the side walls, an outer surface of the first air column adjacent to a joint between the side walls forms a chamfered shape; and first protection walls on outer side surfaces of the side walls of the box body, wherein each of the first protection walls comprises two first protection portions, each first protection portion comprising a first protection air column, and being attached on the first air column which forms the chamfered shape, and the first protection walls are connected to the joint of the side walls and are located on the outer side surfaces of the side walls in a reflexed manner.

16. The air-sealed bag with enhanced side and corner protection according to claim 15, wherein the first protection air columns of the first protection walls further extend to an outer side surface of the bottom wall.

17. The air-sealed bag with enhanced side and corner protection according to claim 15, further comprising a cover body and second protection walls, wherein the cover body is formed by a plurality of second air columns, the cover body is combined with the box body to cover the receiving space, the cover body comprises two side walls and a top wall, wherein the side walls thereof are connected with the top wall to form a socket space, and among the second air columns of the side walls thereof, an outer surface of the second air column adjacent to a joint between the side walls of the cover body forms another chamfered shape, the second protection walls are on outer side surfaces of the side walls of the cover body, each of the second protection walls comprises two second protection portions, each second protection portion comprises a second protection air column, and each of the second protection portions is attached on the second air column of which the outer surface forms the another chamfered shape.

18. The air-sealed bag with enhanced side and corner protection according to claim 17, wherein the second protection air columns of the second protection walls further extend to an outer side surface of the top wall.

19. The air-sealed bag with enhanced side and corner protection according to claim 17, wherein each second protection wall further comprises a second planar portion between the second protection portions, and two sides of the second planar portion are respectively connected with the second protection air columns of the second protection portions.

20. The air-sealed bag with enhanced side and corner protection according to claim 17, wherein each second protection wall is connected to an upper side of one of the side walls and is located on the outer side surface of one of the side walls in a reflexed manner.

21. The air-sealed bag with enhanced side and corner protection according to claim 17, wherein the second protection walls are connected to joints of the side walls and are located on the outer side surfaces of the side walls in a reflexed manner.

* * * * *